United States Patent [19]

Horwitz

[11] 4,091,574

[45] May 30, 1978

[54] TOOL SHARPENING FIXTURE FOR A GRINDING TOOL

[76] Inventor: Norman H. Horwitz, 6608 Cottonwood Knoll, West Bloomfield, Mich. 48033

[21] Appl. No.: 806,821

[22] Filed: Jun. 15, 1977

[51] Int. Cl.[2] ..... B24B 3/60; B24B 21/10

[52] U.S. Cl. ..... 51/141; 51/218 A

[58] Field of Search ..... 51/135 R, 141, 102, 51/220, 216 R, 216 A, 218 R, 218 A

[56] References Cited

U.S. PATENT DOCUMENTS

| | | | |
|---|---|---|---|
| 411,217 | 9/1889 | Dick | 51/220 |
| 981,810 | 1/1911 | Sterling | 51/218 A |
| 1,206,791 | 12/1916 | Anderson | 51/220 |
| 2,352,690 | 7/1944 | Clausing | 51/141 |
| 2,594,574 | 4/1952 | Marsden | 51/220 |
| 2,832,179 | 4/1958 | Beltram | 51/135 R |
| 3,969,848 | 7/1976 | DeMusis | 51/141 |

FOREIGN PATENT DOCUMENTS

| | | | |
|---|---|---|---|
| 771,982 | 4/1957 | United Kingdom | 51/135 R |
| 518,321 | 8/1976 | U.S.S.R. | 51/135 R |

*Primary Examiner*—Harold D. Whitehead
*Assistant Examiner*—Nicholas P. Godici
*Attorney, Agent, or Firm*—Cullen, Settle, Sloman & Cantor

[57] ABSTRACT

A tool sharpening fixture for a conventional grinding tool having a base mounted on a table, at least a pair of spaced pulleys on the base, and a continuous flexible abrasive belt mounted on and around the pulleys, with one of the pulleys being power-driven. The tool-sharpening fixture has an upwardly extending leg for mounting the fixture upon a support, such as the grinding tool table. An elongated tool support arm is pivotally mounted at one end upon the leg. A calibrated protractor plate is secured to the arm at its pivotal mounting. A manual fastening device on the leg secures the arm and protractor in a predetermined angular position relative to the leg. A tool anchor plate extends transversely of the arm and is slidably mounted thereon for longitudinal adjustment to receive tools of different lengths. A friction device is provided upon said anchor plate for securing the anchor plate in adjusted position on the arm. An elongated upright platen of arcuate shape and transversely flat is mounted on said base and supportably and guidably bears against the interior surface of the belt, said platen preferably being in the form of a French curve substantially and terminating in a straight portion. The anchor plate supportably and retainingly engages one end of a tool, with the blade edge forcefully applied to the belt and against the corresponding formed surface of the platen to define at said point of engagement a corresponding form of the belt surface as it moves over the platen for cutting into the edge face of the tool blade to be sharpened or finished, a flat or hollow ground edge.

15 Claims, 5 Drawing Figures

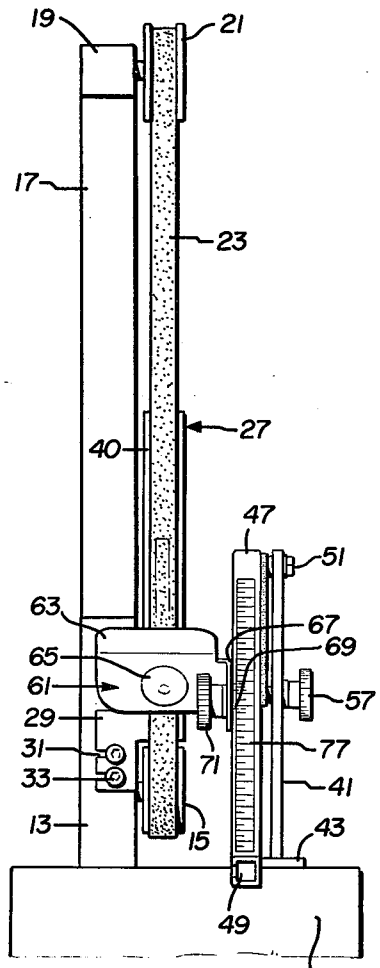
FIG. 1
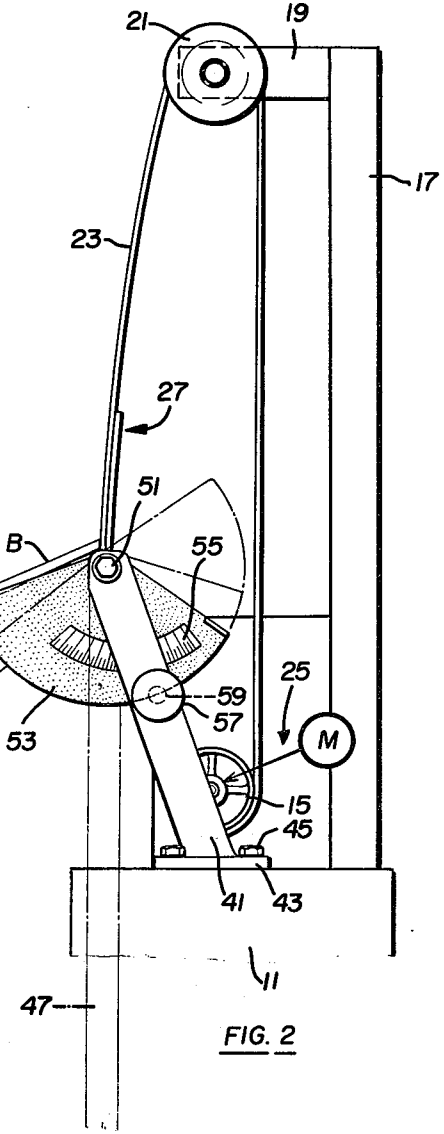
FIG. 2
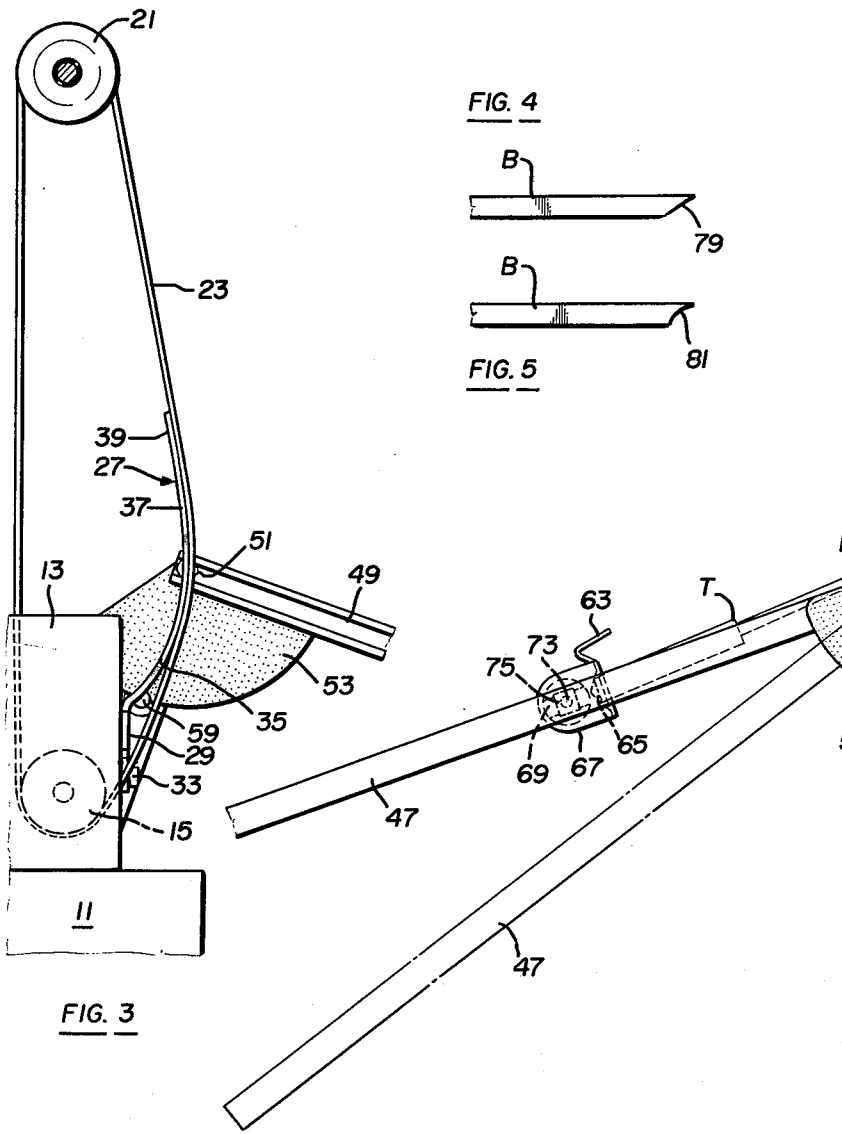
FIG. 3
FIG. 4
FIG. 5

TOOL SHARPENING FIXTURE FOR A GRINDING TOOL

BACKGROUND OF THE INVENTION

The present invention relates to a grinding tool fixture for sharpening of wood cutting tools, for example chisels, gouges, plane irons, scrapers, etc. The fixture is adapted to be mounted on a conventional sander-grinder having a thin belt frictionally driven on pulleys.

Heretofore, there have been provided grinding tools which have a base and which are mounted upon a table and include at least a pair of vertically spaced pulleys with a continuous flexible abrasive belt arranged in an upright plane and mounted around such pulleys, one of said pulleys being power-driven.

Heretofore, there has been provided upon the base for the grinding tool an upright platen which is perfectly flat and which is adapted to supportably engage the corresponding interior portion of said flexible abrasive belt over which the belt moves. The tool to be sharpened including its handle was normally manually held by the operator so that the cutting edge thereof engages the continuously moving abrasive belt with the belt being backed up by the corresponding upright platen.

SUMMARY OF THE INVENTION

The present invention is directed to a grinding tool having a platen of irregular shape, such as arcuate, as for example, a French curve, and terminating in a straight portion adapted to supportably underly parts of the continuously movable abrasive belt whereby, at the point of application of the blade edge to the belt, the belt takes a shape corresponding to the underlying irregular surface of the platen to thus provide in the ground cutting edge of the tool blade a surface which corresponds to the then adjacent portion of the platen, either flat or arcuate so as to provide flat or hollow ground edge.

The present invention also contemplates a tool sharpening fixture which includes an elongated tool support arm which is pivotally mounted at one end upon a suitable support and which includes an anchor plate for supportably receiving and retainingly engaging one end of a tool to be sharpened. The tool including its blade normally extends from the anchor plate in a direction substantially parallel to the pivotal support arm such that the tool engages the abrasive belt substantially tangent to the corresponding surface of the irregular platen upon the underside of said belt supportably and guidably engaging said belt. The anchor plate may be longitudinally adjustable with respect to the arm to accommodate different lengths of tools and the arm itself may be pivotally adjusted with respect to its support to thus present the blade to be ground to the continuously movable abrasive belt at such point relative to the corresponding irregular surface of the platen and similarly deforming the belt at that point for defining in the tool blade a corresponding surface, either flat or undercut.

The present invention provides for friction-locking devices for securing the tool support arm in a predetermined measurable angular position for registry with the belt and supporting platen and to additionally adjustably secure the anchor plate along said arm.

The foregoing invention may be better understood by the illustration of a preferred embodiment of the invention, shown in the attached drawing.

THE DRAWING

FIG. 1 is a front elevational view of the present tool sharpening fixture for a grinding tool as mounted upon a table, fragmentarily shown.

FIG. 2 is a right-side elevational view thereof.

FIG. 3 is a fragmentary left-side elevational view thereof.

FIG. 4 is a fragmentary side view of a tool blade.

FIG. 5 is a similar view of another tool blade.

It will be understood that the above drawings illustrate merely a preferred embodiment of the invention, and that other embodiments are contemplated within the scope of the Claims hereafter set forth.

DETAILED DESCRIPTION OF THE INVENTION

Referring to the drawing, the present tool sharpening fixture is designed for a grinding tool of conventional construction, which is shown in the drawings to include an upright base 13 supportably mounted and secured upon table 11, fragmentarily shown. A drive pulley 15 is journalled and supported upon base 13. The base includes an upright 17, FIGS. 1 and 2, which terminates at its upper end in a forwardly extending support arm 19 upon which is journalled and mounted an additional pulley 21.

An elongated generally upright continuous abrasive belt 23 of flexible material extends around and is supported upon the respective pulleys. In the conventional construction of the grinding tool, there is provided a suitable motor schematically shown at M and having an output which drivingly connects as at 25 the pulley 15 in a conventional manner so as to provide a rotative drive for the continuous abrasive belt.

The irregularly shaped belt support platen 27, FIG. 2, provides a backing for the belt at and along the area where the tool blade is normally applied for sharpening purposes. Said platen at its lower end includes the upright mount plate 29 having a pair of laterally extending spaced slots 31 which receive the fasteners 33 for locating and anchoring the mount plate and the platen to base 13 in the manner shown in FIGS. 1 and 3.

The platen adjacent the base plate 29 has an outwardly bowed portion 35 of arcuate shape which merges in an arcuate portion 37 of nonuniform radius so as to define substantially a French curve and which terminates in the substantially flat portion 39 at the upper end of said platen.

Said platen is transversely flat at 40 across its width and is of a width at least as wide and preferably wider than belt 23.

The platen is adjustably mounted by its mounting plate 29 upon the base 13 in such a fashion as to properly center and position the platen so as to lie rearwardly of the belt and to conform the belt substantially to its overall arcuate shape as best shown in FIG. 3.

TOOL BLADE SHARPENING FIXTURE

The present fixture is adapted for use in conjunction with the continuously movable grinding belt 23 and includes the upwardly and forwardly inclined leg 41, at its bottom having a mounting plate 43 secured to said table by fasteners 45. Elongated support arm 47 is of tubular form, preferrably square in cross section and upon one side has an elongated lateral slot 49.

Pivot bolt 51 extends through leg 41 at its upper end and is secured to support arm 47. The flat protractor 53 with calibrations 55 from 0° to 90° is secured along one edge to the pivot arm 47 and is centered at the pivot bolt 51. The pivot axis of the arm 47 is defined by bolt 51, which is substantially in alignment with platen 27 as shown in FIG. 2. The pivot axis intersects the platen substantially at the transistion between the curved and linear portions, 37 and 39 respectively.

The friction wheel 57 is threaded onto a suitable stud which extends from disc 59 on the opposite side of the protractor, said stud being slotted to receive the edges of said protractor. Accordingly, the friction wheel when tightened will draw up the friction disc snugly against the protractor relative to the leg for securing the support arm in any desired angular position, as determined by the protractor calibrations 55.

Tool anchor plate 61 extends laterally at right angles to the support arm 47, includes the forwardly extending top flange 63 and has a cup-shaped depression 65 to receive the end of the handle of the tool T whose blade B is to be sharpened.

Mounting plate 67 extends rearwardly of said anchor plate and includes an elongated rectangular outwardly projected boss 69 which slidably engages within the lateral slot 49 in the support arm 47. The friction wheel 71 includes a bolt 73 which extends through said mounting plate and boss and threadedly engages the nut 75 upon the interior of arm 47 and which spans its lateral slot. Thus, the tool anchor plate may be longitudinally adjusted along the support arm 47 and secured in the desired adjusted position by said friction wheel.

The top surface of the support arm has calibrations thereon at 77 relative to which the tool anchor plate may be moved and thereafter, secured in position by adjusting said friction wheel.

The advantage of the calibrations 77 is that for a particular tool to be sharpened, the anchor plate may be preset at approximately the correct position for receiving the tool with the handle of the tool supportably nested within the cup 65 within the tool anchor plate.

With the present tool sharpening fixture, the tool support arm 47 may be angularly adjusted so as to properly position the forward edge of the blade to be sharpened with respect to the continuously movable flexible abrasive belt 23. At the point where the blade engages the belt, the belt will be formed or deflected to conform to the underlying arcuate shape of the platen 27 so that there is ground within the forward edge of the blade B an undercut or hollow ground edge 81, FIG. 5, corresponding to the then adjacent front surface of the platen.

OPERATION

In operation and during grinding with manual pressure applied to the tool handle and blade with the tool supported by the tool anchor plate, the forward edge of the blade to be ground is so arranged with respect to the moving abrasive belt that its edge being ground is substantially transverse to the adjacent portion of the flexible abrasive belt, which is conforming to the adjacent arcuate surface of the platen. Should it be desired to form a flat edge such as at 79, FIG. 4, on the blade, then the support arm 47 will be angularly adjusted and secured in position so that the tool blade engages the continuously movable abrasive belt at a point which is directly over a straight portion of the platen. The straight portion of the platen conforms the belt to a similar shape to accordingly grind within the tool blade the tapered flat surface such as shown at 79, FIG. 4.

The procedure for sharpening a cutting tool is therefore as follows. First place the tool handle T in the recess 65 in the anchor plate 63. Second, adjust the position of the anchor plate on the arm 47 until the blade tip 13 engages the desired portion of the platen 27. For example, where a hollow grind is desired, the anchor plate is adjusted until the tool edge engages the desired curvature 37. If a straight edge is desired, the tool should engage linear portion 39. Where the tool does not have a handle, such as a plane iron, the blunt end is received in the sharp bend above the cup. Third, adjust the angle of the support arm 47 by loosening pivot bolt 51 and moving the arm until the desired cutting angle is obtained. This angle is checked by sighting the space between the blade edge and the belt 23. The position may be checked with bluing on the blade edge. The position "setting" should now be checked and noted, including the calibrations of the anchor plate and the angle. When the tool is to be resharpened, the setting repeated. The tool is now sharpened by hand biasing the blade against the belt. Where the blade edge is arcuate, the blade is rotated in the cup. The belt may move in either direction around the pulleys.

The pivotal adjustment of the support arm 47 permits the operator to so locate the tool blade edge with respect to the underlying platen surface so as to predetermine the shape of the ground undercut edge or straight edge, as the case may be.

The present tool sharpening fixture is adaptable to grind any tool whose forward edge is either hollow ground or flat or tapered and may be set up for grinding in a few seconds.

In view of the calibration on the protractor for a particular tool, the arm may be supported in the desired angular position with respect to the support leg 41 so as to assure that the tool blade will be always presented to the belt for a particular tool at the correct angle to, thus, define the cutting edge of the tool as ground either at 79 or 81, FIGS. 4 and 5.

At the same time, tool anchor plate may be longitudinally adjusted and secured in the desired adjusted position along the support arm 47 to accommodate tools and blades of different lengths.

Having described my invention, reference should now be had to the following Claims.

I claim:

1. In combination, a tool sharpening fixture and a grinding tool having at least a pair of spaced pulleys, a continuous flexible abrasive belt mounted around said pulleys, one of said pulleys being power-driven;

said fixture comprising a leg for mounting said fixture upon said grinding tool and securement thereto;

an elongated support arm at one end pivotally, angularly and adjustably mounted upon said leg;

a manually releasable retainer means on said leg securing said arm at a predetermined angular position relative to said leg;

a tool anchor plate extending laterally of said arm;

means slidably mounting said anchor plate upon said arm along its length, to support different lengths of tools to be sharpened;

releasable means on said arm for securing said anchor plate in longitudinally adjusted position;

and an elongated upright platen of generally arcuate shape mounted upon the base of said grinding tool and supportably and guidably bearing against the interior surface of said belt;

said anchor plate adapted to supportably and retainingly engage the handle of a tool, with its blade applied to said belt adjacent the underlying surface of said platen;

so that manual pressure applied to said tool causes the tool cutting edge to contact the grinding surface of said belt corresponding to the adjacent underlying shape of the platen, whereby a flat or hollow ground edge is formed in said blade;

the pivot axis of said arm to said leg being generally in registry with said arcuate platen surface.

2. In the combination of claim 1, a calibrated protractor plate secured to said arm adjacent its pivotal mounting, said manual releasable retainer means securing said protractor in adjusted position.

3. In the combination of claim 1, said platen being transversely flat and rectangular in cross section, and at least as wide as said belt.

4. In the combination of claim 1, the mounting of said platen including a flat mounting plate at the lower end of said platen; and fasteners securing said plate to said support.

5. In the combination of claim 4, said platen adjacent its mounting plate being bowed forwardly away from said base to guidably support adjacent portions of said belt.

6. The combination of claim 1, wherein said platen includes an arcuate portion having a continuously changing radius of curvature and a relatively straight portion.

7. The combination of claim 6, wherein the pivot axis of said support arm intersects said platen adjacent the transition between said curved and straight portions.

8. In the combination of claim 2, said protractor plate having an arcuate bottom edge at a uniform radius relative to the arm pivotal mounting; the calibrations being arcuate and generally parallel to said arcuate edge.

9. In the combination of claim 8, said manually releasable retainer means continuously bearing against said protractor arcuate edge throughout angular adjustments of said arm.

10. In the combination of claim 1, said tool-anchoring plate having a cup-shaped depression therein to supportably receive the handle of the tool to be sharpened; said tool handle and the connected blade lying substantially parallel to said arm.

11. In the combination of claim 1, the mounting of said anchor plate upon said arm including a mount plate at right angles to and extending rearwardly of said anchor plate; said mount plate bearing against and slidable over a side wall of said arm.

12. In the combination of claim 1, said arm being tubular and square in cross section and having a lateral slot through and along a side wall thereof; the mounting of said anchor plate upon said arm including a mount plate at right angles to and extending rearwardly of said anchor plate; said mount plate bearing against and slidable over the slotted side wall of said arm; and an elongated boss of rectangular shape extending laterally of said mount plate and guidably projected into the lateral slot of said arm.

13. In the combination of claim 12, said releasable means on said arm including a manually-rotatable bolt extending through said mount plate and threadedly engaging a rectangular nut upon the interior of said arm and spanning its longitudinal slot.

14. In the combination of claim 1, an elongated calibration upon the top surface of said support arm in registry with said tool anchor plate.

15. In the combination of claim 1, said platen being in the form of a French curve, terminating adjacent its upper end in a straight portion.

* * * * *